US005875833A

United States Patent [19]

Schlüter

[11] Patent Number: 5,875,833

[45] Date of Patent: Mar. 2, 1999

[54] REGENERATIVE HEAT EXCHANGER

[75] Inventor: Siegfried Schlüter, Wenden-Rothemühle, Germany

[73] Assignee: Apparatebau Rothemühle Brandt & Kritzler Gesellschaft mit beschränkter Haftung, Wenden, Germany

[21] Appl. No.: 949,774

[22] Filed: Oct. 14, 1997

Related U.S. Application Data

[63] Continuation of Ser. No. 561,629, Nov. 22, 1995, abandoned.

[30] Foreign Application Priority Data

Nov. 25, 1994 [DE] Germany ..... 44 42 055.02

[51] Int. Cl.[6] ..... F23L 15/02

[52] U.S. Cl. ..... 165/5; 165/95; 15/318

[58] Field of Search ..... 165/95, 5; 15/300.1, 15/316.1, 317, 318, 318.1

[56] References Cited

U.S. PATENT DOCUMENTS

| | | | |
|---|---|---|---|
| 2,355,021 | 8/1944 | Waitkus | 165/5 |
| 2,379,506 | 7/1945 | Yerrick et al. | 165/5 |
| 2,761,653 | 9/1956 | Grames et al. . | |
| 4,428,417 | 1/1984 | Chesner . | |
| 5,044,424 | 9/1991 | Monro | 165/5 |
| 5,397,548 | 3/1995 | Kritzler et al. | 165/5 X |

FOREIGN PATENT DOCUMENTS

| | | | |
|---|---|---|---|
| 1028465 | 5/1953 | France | 165/5 |
| 0082698 | 5/1982 | Japan | 165/5 |
| 0033499 | 2/1989 | Japan | 165/5 |
| 0625122 | 8/1978 | U.S.S.R. | 165/5 |
| 0783877 | 10/1957 | United Kingdom | 165/5 |
| 2101259 | 1/1983 | United Kingdom | 165/5 |

OTHER PUBLICATIONS

Rothemühle, "Regenerativ–Luftvorwärmer", [Regenerative Air Preheater], p. 19.

*Primary Examiner*—Ira S. Lazarus
*Assistant Examiner*—Christopher Atkinson
*Attorney, Agent, or Firm*—Friedrich Kueffner

[57] ABSTRACT

A regenerative heat exchanger for gaseous media which are in a heat exchange with one another includes stationary or rotating storage masses and at least one cleaning device for the storage masses, wherein the cleaning device can be pivoted in relation to the annular cross section of the storage masses from the inside toward the outside or vice versa. The regenerative heat exchanger can be used for the preheating of air as well as for the preheating of gas. The free end of a swivel arm of the cleaning device constructed as a blow tube has a bent portion which extends parallel to the plane of the storage masses and the bent portion is provided with at least two blow nozzles.

4 Claims, 3 Drawing Sheets

REGENERATIVE HEAT EXCHANGER

This is a conituation of application Ser. No. 08/561,629 filed Nov. 22, 1995, now abandoned.

BACKGROUND OF THE INVENTION

1. Field of the Invention

The present invention relates to a regenerative heat exchanger for gaseous media which are in a heat exchange with one another. The regenerative heat exchanger includes stationary or rotating storage masses and at least one cleaning device for the storage masses, wherein the cleaning device can be pivoted in relation to the annular cross section of the storage masses from the inside toward the outside or vice versa. The regenerative heat exchanger can be used for the preheating of air as well as for the preheating of gas.

2. Description of the Related Art

The air preheater is used in power plant furnaces and industrial furnaces for preheating the combustion air. The gas preheater is used for preheating in the case of exhaust gas purifying processes, for example, in catalytically operating reactors, or for reheating in the case of gas scrubbing processes.

To the extent necessary, the heating surfaces of the storage masses are constructed so as to be resistant to soiling. Usually, the heating surfaces are enameled; in some cases, enameled heating surfaces are used at the hot end and heating surfaces of high-grade synthetic material are used at the cold end. However, for various reasons, a contamination of the heating surfaces cannot be prevented. It has been found that progressive clogging can be caused by very fine dust which is capable of baking from cold dust firings as well as by the precipitation of moisture when the temperature drops below the dew point. Therefore, it is known in the art to carry out a periodic cleaning by means of soot blowers during the operation. For achieving a lasting cleaning effect, the blowing devices are arranged at the hot end and the cold end of the heat exchanger. In the case of persistent contamination, for example, cemented or carbonized contamination, chemical rinsing processes and ultrahigh pressure rinsing processes are available.

In air preheaters or gas preheaters having a rotating heating surface carrier, the soot blower and the rinsing device or a support device for an ultrahigh pressure nozzle lance can be mounted at a fixed location. The cleaning media, such as, superheated steam, compressed air, rinsing water or chemical solutions, are introduced at only one location of the circumference because, due to the rotation of the heating surface carrier and the simultaneous radial adjustment of the blower, the entire heating surface comes within the range of the blow jet. For cleaning air preheaters or gas preheaters which have rotating hoods instead of a stationary heating surface carrier, a blowing device is provided which rotates together with the rotating hoods.

In air preheaters of medium size, a blowing or cleaning device is known in the art which includes a rotatable turnstile with nozzles, wherein the turnstile is rotated during each rotation of the hood by a pin spacing by means of a control wheel provided with a number of pins and a tappet which is displaceably mounted on a stationary housing. On the other hand, large air preheaters are equipped with radially displaceable blow tubes instead of a rotatable turnstile with nozzles. The radial movement of the blow tube is produced by the rotary movement of a control wheel and by a crank drive.

In another embodiment, the air preheaters are equipped with a section blower which is controlled by a rotary valve.

In that case, the supply of blow medium is controlled by the rotary movement of a control wheel through a rotary valve in such a way that the section blowers alternatingly direct blow jets against the heating surfaces which are arranged in a ring-like manner (see brochure Rothemühle,"Regenerativ-Luftvorwärmer", [Regenerative Air Preheater], page 19).

The heating surfaces installed in the regenerative heat exchangers in cylindrical housings, i.e., the heating surface carriers, are usually periodically cleaned, i.e., blasted, for example, every eight hours. It has been found in this connection that there are problems with respect to achieving a cleaning of the heating surfaces which is as uniform as possible over the entire annular cross-section which increases from the inside toward the outside for reasons inherent to the system and that certain areas can be cleaned only incompletely or not at all because of the fact that the blow nozzles and heating surfaces cannot be precisely allocated relative to each other and because of an insufficient supply of blow medium. One reason for this is the fact that the blowers and the heating surfaces are moved relative to each other during cleaning. While the average speeds of rotation do not usually change because of the constant rates of rotation, different circumferential speeds occur between the inner area and the outer area of the annular cross-section of the heating surfaces of the heating surface carrier. In practice, attempts are made to eliminate these problems by carrying out blowing procedures more frequently and for longer periods of time. However, this is usually only partially successful and, therefore, the consumption of blow medium is simultaneously increased to quantities which are not economically feasible.

SUMMARY OF THE INVENTION

Therefore, it is the primary object of the present invention to provide an improved cleaning device for a regenerative heat exchanger of the above-described type. In particular, the cleaning device should blow with sufficient intensity over the entire annular cross section of the heating surfaces of the storage masses and, simultaneously, the specific consumption of blow medium, expressed as a ratio of kilogram of the blow medium per square meter of heating surface, should be constant over the entire cross section and should remain within economically justifiable limits.

In accordance with the present invention, the free end of a swivel arm of the cleaning device constructed as a blow tube has a bent portion which extends parallel to the plane of the storage masses and the bent portion is provided with at least two blow nozzles.

The free end of the swivel arm with the bent portion located in the same plane as the swivel arm makes it possible to utilize the expensive blow medium with excellent efficiency and to achieve automatically a uniform specific admission of blow medium to the heating surfaces corresponding to the cross sectional conditions which change from the inside toward the outside as a result of the diameter differences. Thus, while only one nozzle per heating surface ring is effective in the inner portion of the heating surface carrier, two or three or more blow nozzles direct the flow medium against the respective heating surface ring or the corresponding surface of the storage masses depending on the outwardly increasing size of the heating surface rings. The number of flow nozzles depends on the inner diameter and the outer diameter of the heating surface carrier; consequently, if this ratio is, for example, 1:4, four blow nozzles are arranged on the bent portion of the free swivel arm end.

In accordance with a preferred embodiment of the invention, depending on the annular cross section of the storage masses, the the bending angle of the bent portion of the free end of the swivel arm is such that, when the swivel arm is moved inwardly, the blow nozzles extend essentially radially relative to each other and, when the swivel arm is moved outwardly, the blow nozzles extend essentially tangentially relative to each other. In this manner, it is possible to achieve that the blow nozzles are arranged radially in alignment in the inner central portion of the heating surface carrier and the blow nozzles extend in tangential alignment in the outer portion of the heating surface carrier. As a result, the blow medium is admitted to the inner heating surface rings from only one blow nozzle, while blow medium is admitted to the outer heating surface rings from all blow nozzles which are then located one behind the other in the direction of rotation. In the portions between the inner and outer heating surface rings, blow medium is admitted to the surfaces of the storage masses to be cleaned from two or three blow nozzles. Accordingly, neither too little nor too much cleaning medium is directed against each heating surface ring for a sufficiently intensive cleaning of the heating surfaces, and a uniform specific quantity of blow medium is admitted to the heating surfaces even though the cross sectional conditions change.

A further development of the present invention provides that the bent portion of the swivel arm has an angle which is adapted to the radius of curvature of the outer annular cross-section of the storage masses. This makes it possible to optimize the use of the blow nozzles to ensure the intended efficiency.

In accordance with an advantageous feature, the adjustment of the swivel arm is infinitely variable. Alternatively, the adjustment of the swivel arm is stepwise, for example, with the use of a process control which makes it possible to carry out the desired adjustment steps, for example, in a continuously increasing or decreasing manner.

The arrangement of the blow nozzles or the relative spacing between blow nozzles and/or the adjustment of the swivel arm should always be in such a way that as seamless as possible a transition is ensured by avoiding areas in which no blow medium is admitted, wherein slight overlaps of the blow jets are less disadvantageous as areas in which no blow medium is admitted. In this manner, specific uniform quantities of blow medium are admitted to the heating surfaces. On the other hand, the diameters of the nozzles can be equal, and it is apparent that the diameters of the nozzles are selected in accordance with the required blowing effect and the penetration depths of the blow jet and are adapted to the capability of the heating surfaces to absorb loads.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
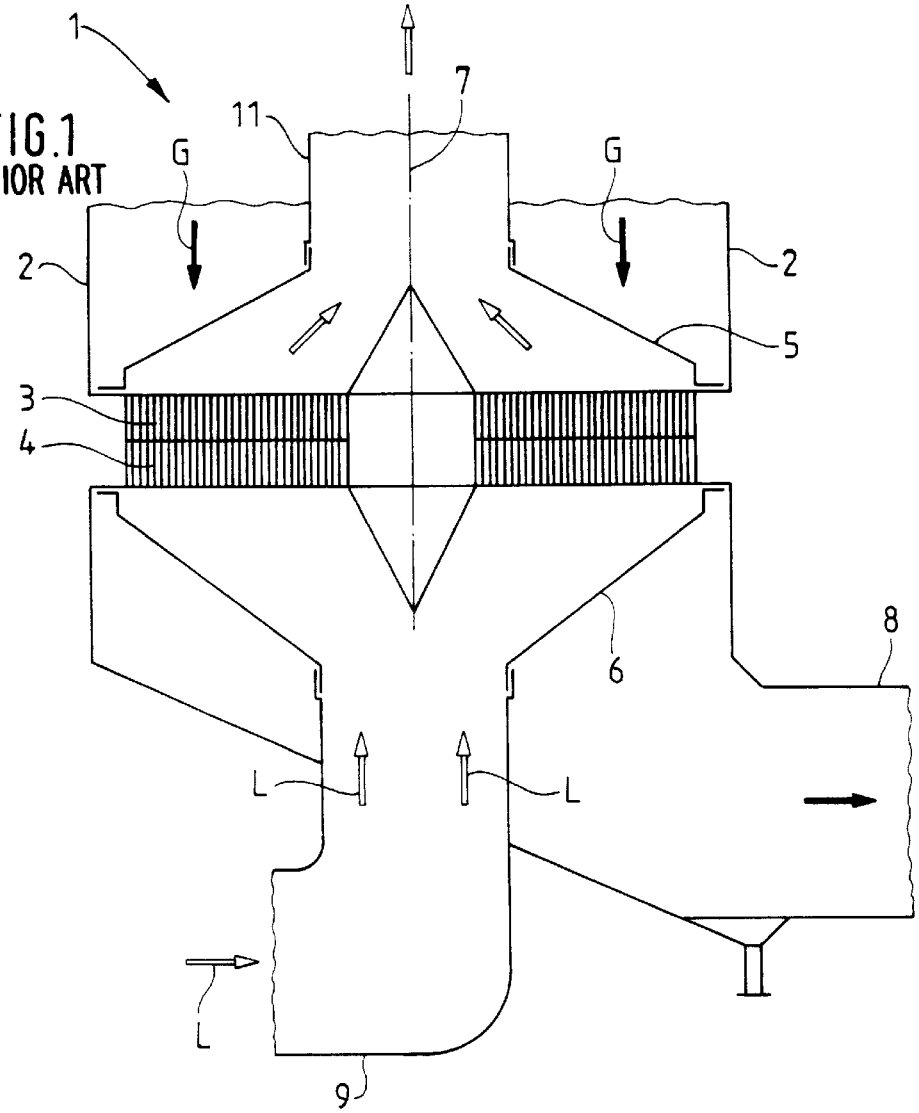
FIG.1 PRIOR ART
FIG. 1 is a schematic representation of a regenerative heat exchanger having rotating hoods.

FIG. 1 of the drawing shows a regenerative heat exchanger 1 in the form of an air preheater. Hot exhaust gas G from a steam producer, not shown, flows to the regenerative heat exchanger 1 though a duct 2. Consequently, the hot gas G flows from the top into the regenerative heat exchanger 1. The regenerative heat exchanger 1 has a middle portion composed of stationary storage masses 3 and 4. Arranged on both sides of the storage masses 3 and 4 are segmented hoods 5, 6, respectively, which rotate together about a vertical axis 7. The hoods 5, 6 rotate continuously, so that always different portions of the storage masses are subjected to the hot gas G because of the rotary movement. The storage masses 3, 4 are heated by the gas G, the gas G is cooled as a result, and the gas leaves the regenerative heat exchanger 1 at the bottom end through the duct 8. A line 9 is connected to the hood 6 at the bottom end of the regenerative heat exchanger 1.

Figure 2:
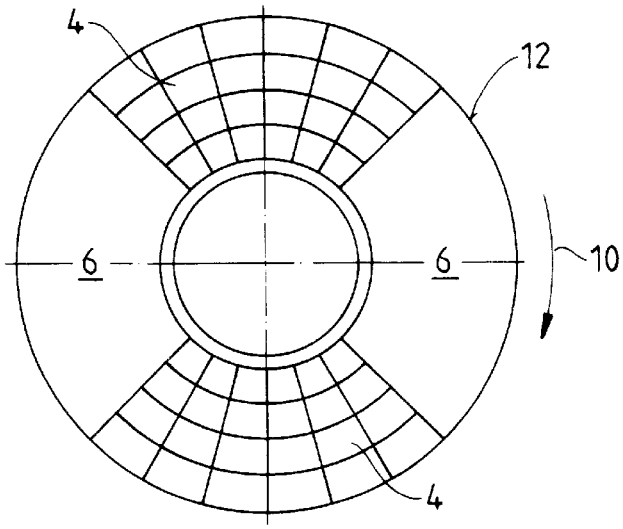
FIG.2 PRIOR ART
FIG. 2 is a cross-sectional view of the regenerative heat exchanger shown in FIG. 1, seen in the plane of air entry in the direction of the inflow of air.

Cold combustion air L flows through the line 9 in a countercurrent flow to the gas G through the hood 6 which rotates in the direction 10 of rotation shown in FIG. 2 and flows against the storage masses 3, 4 which are heated by the gas G. The air L cools the storage masses 3, 4 and flows as hot air through a duct 11 to the furnace through the upper hood 5 which rotates together with the hood 6, as shown in FIG. 1.

Figure 3:
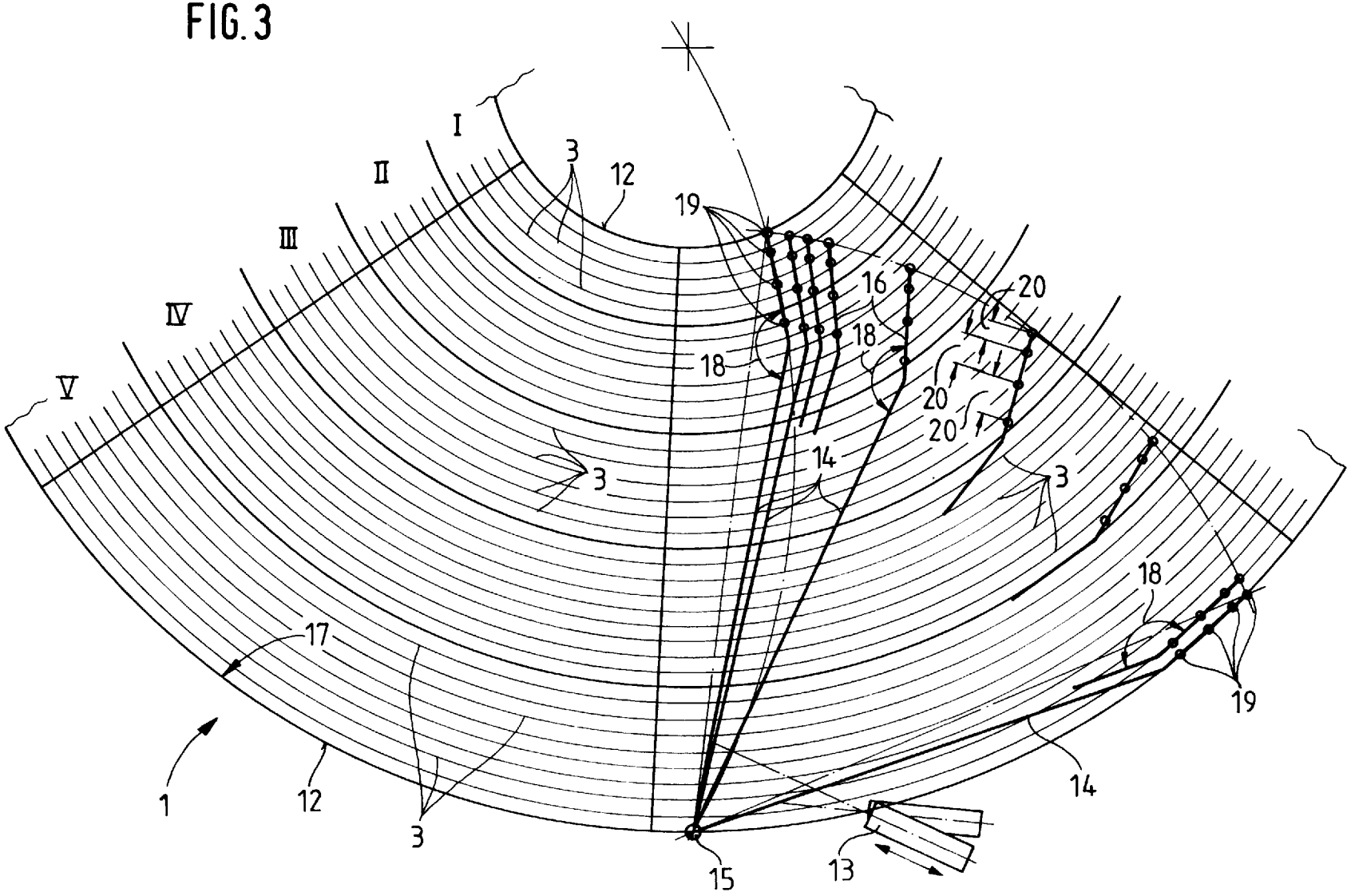
FIG. 3 is a schematic partial illustration of a heating surface carrier with a swivel arm whose free end has a bent portion and blow nozzles are arranged on the bent portion.

In the embodiment illustrated in FIG. 3 of the drawing, the cylindrical heating surface carrier 12 is divided into annular sectors I through V. For cleaning the heating surfaces of the storage masses 3 arranged tightly next to one another in the cylindrical heating surface carrier, a swivel arm 14 constructed as a blow tube is provided. The swivel arm 14 can be adjusted by a suitable adjustment drive 13 either in an infinitely variable manner or in a stepwise manner. In FIG. 3, the swivel arm 14 is illustrated in several intermediate positions.

The free end of the swivel arm 14 remote from the swivel axis 15 is constructed with a bent portion 16 which extends in the plane of the swivel arm; the bent portion 16 has an angle 18 relative to the swivel arm 14 which is adapted to the radius 17 of the curvature of the outer annular cross-section of the storage masses 3 or the heating surface carrier 12. On the bent portion 16 of the free end of the swivel arm 14, a group of nozzles are provided. In the embodiment illustrated in FIG. 3, four blow nozzles 19 are provided. When the swivel arm 14 is adjusted uniformly in a stepwise manner, the blow nozzles 19 are arranged with varying spacings 20 therebetween. As illustrated, the spacings 20 increase in size from the free end of the swivel arm 14 toward the bend 16.

By arranging the blow nozzles 19 on the bent portion 16 of the free end of the swivel arm 14, it is ensured that the blow nozzles 19 extend essentially radially in alignment with each other in the central inner portion of the heating surface carrier 12 and that the blow nozzles 19 extend essentially in tangential alignment relative to each other in the outer portion of the heating surface carrier 12. Accordingly, the surfaces of the storage masses arranged in the annular sector I are subjected to only one blow nozzle 19 in accordance with the smaller surface area, while the heating surfaces of the storage masses 3 in the outer annular sector V are subjected to all four blow nozzles 19 corresponding to the surface area which is four times greater. Consequently, the surfaces of the storage masses 3 are subjected to equal specific quantities of cleaning medium corresponding to the respective cross sectional conditions of the heating surface carrier 12.

Figure 4:
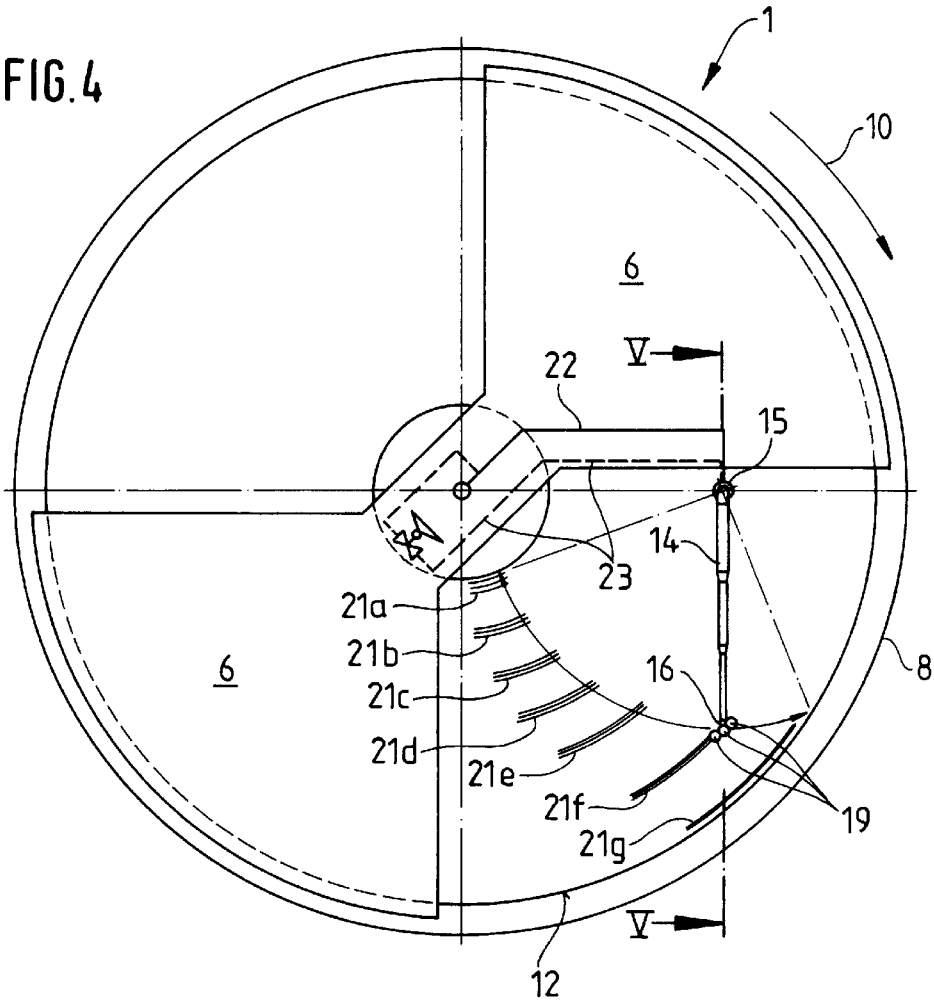
FIG. 4 is a top view of the bottom side of a regenerative heat exchanger equipped with stationary storage masses and rotating hoods and a swivel arm for cleaning the heating surfaces attached to the lower hood, wherein the free end of the swivel arm has a bent portion and blow nozzles mounted on the bent portion.

FIG. 4 of the drawing shows the bottom side of a regenerative heat exchanger having rotating hoods and a stationary heating surface carrier 12 in accordance with FIG. 2. However, in FIG. 4, only the outlines are shown for clarity's sake, while the annular sectors and the storage masses 4 arranged in the annular sectors are not shown.

Figure 5:
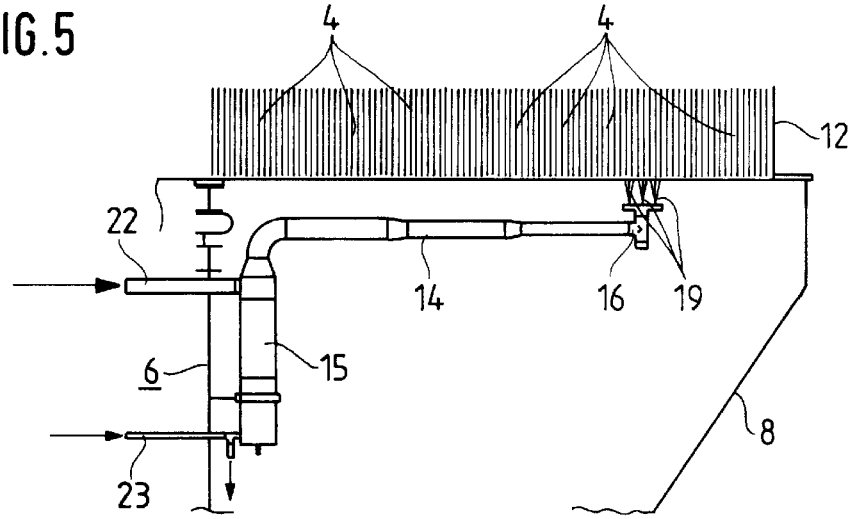
FIG. 5 is a sectional view taken along sectional line V—V of FIG. 4 showing the swivel arm as a detail.

In the embodiment illustrated in FIG. 5, the swivel arm 14 for the storage masses of the heating surface carrier 12, mounted on the swivel axis 15 which rotates together with the hood 6, has three blow nozzles 19 on the bent portion 16 at the free end; when the swivel arm 14 is moved, these three blow nozzles 19 travel along the heating surface carrier 12 from the inside toward the outside or vice versa and supply cleaning medium to the storage masses 4. As schematically illustrated by the lines 21*a* through 21*f* in FIG. 4, the surfaces of the storage masses 4 are subjected with increasingly more blow nozzles 19 corresponding to the dimensions or heating surface sizes which increase from the inside toward the outside, i.e., corresponding to the changing cross sectional conditions of the heating surface carrier 12.

For cleaning the heating surfaces of the storage masses 3, cleaning steam is supplied to the swivel arm 14 through a supply line 22. For the infinitely variable adjustment of the swivel arm 14, control steam is supplied through a line 23, as shown in FIG. 5. Instead of the adjustment effected by the blow medium, it is also possible to use a mechanical adjustment device.

While specific embodiments of the invention have been shown and described in detail to illustrate the inventive principles, it will be understood that the invention may be embodied otherwise without departing from such principles.

I claim:

1. A regenerative heat exchanger for gaseous media which are in a heat exchange with one another, the regenerative heat exchanger comprising storage masses, the storage masses having an annular cross section, and at least one cleaning device comprising a swivel arm having a free end, the swivel arm extending in a plane and being mounted so as to be adjustable inwardly and outwardly relative to the annular cross section of the storage masses, the storage mass extending in a plane, the swivel arm having a bent portion at the free end thereof, wherein the bent portion extends in the plane of the swivel arm and parallel to the plane of the storage masses, the swivel arm being a blow tube, further comprising at least two blow nozzles mounted on the bent portion, wherein the bent portion has such an angle that the blow nozzles extend essentially radially relative to one another relative to the annular cross section of the storage masses when the swivel arm is moved inwardly and the blow nozzles are arranged essentially tangentially relative to each other in relation to the annular cross section of the storage masses when the swivel arm is moved outwardly, and wherein the angle of the bent portion corresponds to a radius of curvature of an outer annular cross section of the storage masses, such that a geometric relationship between the blow nozzles and the storage masses causes less cleaning agent to be applied to inwardly located portions of the storage masses and increasingly more cleaning agent to be applied to outwardly located portions of the storage masses.

2. The regenerative heat exchanger according to claim 1, wherein the blow nozzles have varying spacings between each other.

3. The regenerative heat exchanger according to claim 1, comprising means for infinitely variably adjusting the swivel arm.

4. The regenerative heat exchanger according to claim 1, comprising means for a stepwise adjustment of the swivel arm.

* * * * *